United States Patent [19]

Albrecht

[11] 4,106,831

[45] Aug. 15, 1978

[54] REVOLVING CABLE-TO-HOUSING CONNECTION

[75] Inventor: Werner Albrecht, Nuremberg, Fed. Rep. of Germany

[73] Assignee: Kabel-und Metallwerke Gutehoffnungshutte AG., Hanover, Fed. Rep. of Germany

[21] Appl. No.: 813,820

[22] Filed: Jul. 8, 1977

Related U.S. Application Data

[63] Continuation of Ser. No. 651,189, Jan. 21, 1976, abandoned.

[30] Foreign Application Priority Data

Jan. 16, 1975 [DE] Fed. Rep. of Germany ..... 2501582

[51] Int. Cl.[2] ..... H01R 3/06

[52] U.S. Cl. ..... 339/8 R; 339/6 R

[58] Field of Search ..... 339/8 R, 8 A, 8 P, 8 PB, 339/6 R

[56] References Cited

U.S. PATENT DOCUMENTS

| | | | |
|---|---|---|---|
| 2,257,506 | 9/1941 | MacDonald | 339/8 A X |
| 3,398,260 | 8/1968 | Martens | 339/8 P X |
| 3,937,543 | 2/1976 | Tomaro | 339/8 P X |
| 3,950,052 | 4/1976 | Walter et al. | 339/8 R |
| 3,957,331 | 5/1976 | Tantillo et al. | 339/8 R X |
| 3,963,291 | 6/1976 | Maloof | 339/8 P |
| 4,003,616 | 1/1976 | Springer | 339/8 R |
| 4,040,696 | 8/1977 | Wada et al. | 339/8 R |

*Primary Examiner*—Roy Lake
*Assistant Examiner*—DeWalden W. Jones
*Attorney, Agent, or Firm*—Ralf H. Siegemund

[57] ABSTRACT

A revolving feed through connection has a socket member to which are connected mechanically the electrical conductors; a pair of coaxial conductors are mounted on the socket member and electrically to the said cable conductors while being insulated from each other; a sleeve made of strong material is mounted on the socket member and is firmly connected thereto. Means in the housing define a bearing for the sleeve and receiving the sleeve for permitting turning of the socket with the sleeve about an axis, which is coaxial to the conductors of the pair. The sleeve and bearing are constructed for axially retaining the sleeve in the bearing.

3 Claims, 2 Drawing Figures

REVOLVING CABLE-TO-HOUSING CONNECTION

This is a continuation of application Ser. No. 651,189, filed Jan. 21, 1976, now abandoned.

BACKGROUND OF THE INVENTION

The present invention relates to a rotary or revolving connection of an electrical conductor, cable, or the like, to a more or less rigid, i.e., rather inflexible housing or casing containing for example an electric load and pertaining, therefore, to an appliance, a tool, or the like.

Revolving feed through connections are needed whenever the cable or conductor leading to an apparatus, device, etc., should not be twisted during handling. Other situations require conductors to run through a pivot joint of an apparatus, a machine, or the like, and again twisting of the conductors is to be prevented. It is apparent that those portions of the conductors or cable which are located right at the respective casing wall are endangered the most, because the conductors or cables are held at these points more or less firmly unless the points of holding yield to rotation about an axis transversely to the wall. Clearly, instruments, tooling or the like which are being moved in some fashion require most prominently that the conductors be protected against twisting.

The German printed patent application No. 2,153,418 discloses a continuous turnable conductor coupling purporting to solve the aforementioned problem. This particular coupling has an internal mechanism which permits rotation of two parts relative to each other. The conductors are inserted into the two parts and are interconnected inside of the coupling by means of U-shaped contact elements and pins or the like. Unfortunately, this coupling requires a considerable number of individual parts and is, therefore, quite expensive. Moreover, the coupling includes parts through which runs electrical current and serve also as bearings or as load supports.

DESCRIPTION OF THE INVENTION

It is an object of the present invention to provide a new and improved rotational or revolving feed through connection of conductors to an electric load minimizing the number of parts and relieving the conductors from mechanical loads as may result from turning.

In accordance with the preferred embodiment of the present invention, it is suggested to provide a socket member to which are connected mechanically the electrical conductors; a pair of coaxial conductors are mounted on the socket member and are connected electrically to the said cable conductors while being insulated from each other; a sleeve is mounted on said socket member and is firmly connected thereto. In particular, the sleeve is made of a material which has significant mechanical strength. Means are provided in the housing defining a bearing for the sleeve and receiving the sleeve permitting turning of the socket with the sleeve about an axis, which is coaxial to the conductors of the pair. Moreover, the sleeve and bearings are constructed for axially retaining the sleeve in the bearing. Electrical connection inside of the casing or housing are made through suitable slip rings or the like or through a connector plug which permits turning of the above-mentioned socket contracts. Decisive here is that the mechanical load of the rotation is not to be taken up by the electrical connection.

The rotational connection in accordance with the preferred embodiment of the present invention has a significant advantage that no independently movable parts are provided in the socket beginning rotational support.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
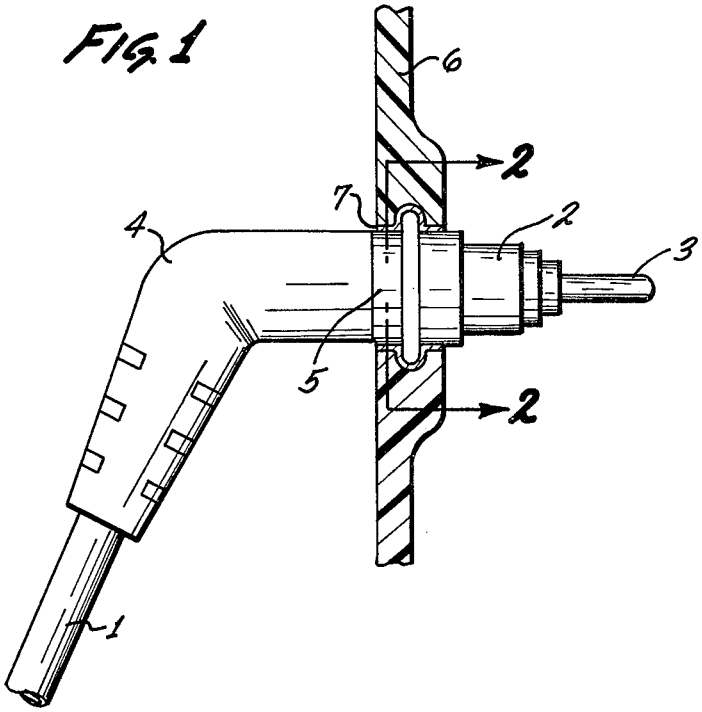
FIG. 1 is a somewhat schematic section view of a rotational cable connection in accordance with the preferred embodiment of the invention and FIG. 2 is a section view along lines 2 — 2 FIG. 1.
Figure 2:
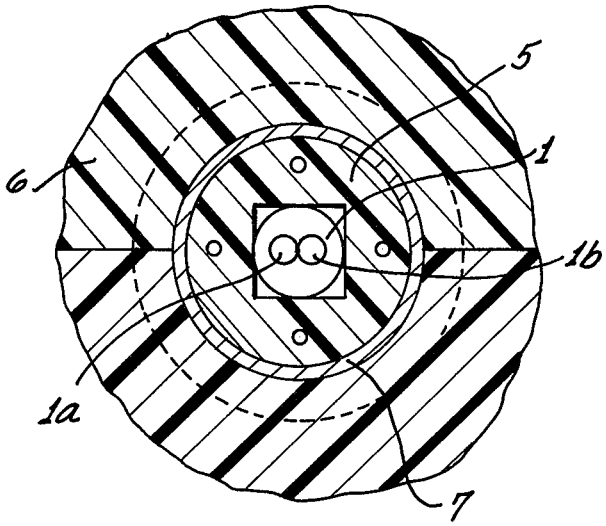

Proceeding now to the detailed description of the drawings, the figures show a cable 1 having two conductors 1*a* and 1*b* in an insulating jacket. This conductor 1 terminates in a socket member 4 made of insulative material and being preferably made by way of extrusion, injection molding or the like. The socket member 4 is of a bent configuration and establishes a basic support body for rotary connection.

A central conductor pin 3 extends from the end of socket member 4 opposite the point of insertion of cable 1. An annular contact 2 surrounds contact pin 3, but is still insulated therefrom by the material of the insulative body of socket member 4.

An annular member or sleeve 5 is firmly seated on and surrounds body 4. In addition, member 5 has an itnernal bore of rectangular cross-section for receiving the round cable 1, leaving corner spaces. The sleeve 5 is preferably made of hard plastic, but could be made of metal. Of course, in the latter case, additional insulation may be required relative to contact ring 2 unless, the particular apparatus permits and even requires that the casing, housing or the like, to which the connection is made, is to have the same potential, e.g. ground potential, if that is potential for the outer conductor 2.

The sleeve 5 is provided with an annular bead 5*a*, which is received in a matingly, i.e. concavely contoured member 7 serving as bearing, in which sleeve 5 may turn. Specifically, member 7 is a sleeve with an internal radial groove receiving bead 5*a*.

The bearing member 7 is embedded in a casing 6, which houses the electric load. As the casing is thicker at this point of penetration, the axially extended inner portion of member 7 bears also against the outer cylindrical surface portion of the sleeve 5, so that the bearing is in effect axially extended; the bead-groove contour provides additionally for an axial retention function to hold the sleeve 5 with socket 4 in the casing 6.

As stated, the sleeve 5 could be made of plastic, and the bearing member 7 may be made of the same material. Care must be taken here that the plastic being used has sufficient mechanical strength. One could, for example, use a polyamid such as nylon, because the surface of a nylon part is not only sufficiently firm and strong, but has also a very low coefficient of friction. It should be noted further that the member 7 is needed as a separate part only if the casing 6 is made of a material that is not or inadequately suitable for providing the bearing function. If the casing is made of the same material as sleeve 5 or at least of a material having similar friction characteristics, member 7 can be omitted and the casing itself will then serve as bearing.

The rotary coupling or connection is made as follows. At first, the cable end is stripped, and contact elements 2 and 3 are connected respectively to the two cable leads in any suitable fashion. Next, the sleeve 5 is placed in a suitable mold, and the cable end with elements 2 and 3 attached is inserted in the sleeve. The mold is then closed in the usual fashion and the body 4 is produced, e.g. by injection molding, extrusion or the like, whereby the contacts 2 and 3 are insulatively positioned and held relative to each other by the resulting socket body. Moreover, the body 4 is molded around the cable 1 and the sleeve 5 will become secured to that body 4 in that the plastic which will constitute that body 4 will flow, of course, into the corner spaces between the rectangular bore of member 5 and the cable jacket 1*c*, thereby establishing keying means impeding rotation between the member 5 and the socket body 4.

The casing 6 has been prepared independently and it may, for example, consist of several parts with a dividing line running so that the parts can be separated and the coupling parts can be inserted. The bearing part 7 also may have been made as a split or divided ring being separately attached to the casing parts and which constitutes a closed bearing after the casing has been closed. Prior to closing, of course, part 5 (holding 4) will be placed so that its bead 5*a* is received by the groove or bearing and now the casing can be closed.

It can thus be seen that the socket member does not contain any parts which rotate relative to each other. The coupling itself is constructively extremely simple. The rotatability of the socket results by the interaction of the sleeve with the bearing constituting a low friction bearing for the socket as a whole.

The invention is not limited to the embodiments described above but all changes and modifications thereof not constituting departures from the spirit and scope of the invention are intended to be included.

I claim:

1. Revolving connection of electrical cable conductors for passing through the relatively inflexible wall of a housing, comprising:

a socket member of a moldable plastic and being molded onto the cable thereby being mechanically connected to the conductors;

a pair of coaxial conductors in the socket member, mechanically and electrically connected to the said cable conductors, in addition to and independent from the mechanical connection for the cable to the socket member and being insulated from each other by a portion of the socket member being integral therewith;

a sleeve on said socket member being made of material having significant mechanical strength;

keying means integral with the socket member and inserted in the sleeve for firmly connecting the socket member to the sleeve and for impeding rotation of the sleeve relative to the socket member;

means in the housing defining a bearing for the sleeve and receiving said sleeve, the means permitting the turning of the socket with the sleeve about an axis coaxial to said conductors of the pairs; and said sleeve and bearing means being constructed for axially retaining the sleeve in the bearing.

2. Connection as in claim 1, said means in the housing including an insert in which said sleeve turns.

3. Connection as in claim 1, said sleeve having an annular, radially extending bead, the means in the housing including a groove receiving said bead.

* * * * *